US006536646B1

(12) United States Patent
Pinczewski et al.

(10) Patent No.: US 6,536,646 B1
(45) Date of Patent: Mar. 25, 2003

(54) STAPLER

(75) Inventors: Morris Pinczewski, New York, NY (US); Valentin Fridmanovich, Forest Hills, NY (US)

(73) Assignee: Acco Brands, Inc., Lincolnshire, IL (US)

( * ) Notice: Subject to any disclaimer, the term of this patent is extended or adjusted under 35 U.S.C. 154(b) by 0 days.

(21) Appl. No.: 09/507,467

(22) Filed: Feb. 22, 2000

(51) Int. Cl.[7] ..... B25C 5/15

(52) U.S. Cl. ..... 227/5; 227/7; 227/131; 227/155

(58) Field of Search ..... 227/5, 7, 120, 227/131, 155

(56) References Cited

U.S. PATENT DOCUMENTS 5,076,483 A * 12/1991 Olesen ..... 227/155
5,230,457 A * 7/1993 Hiroi et al. ..... 227/131
5,460,314 A * 10/1995 Udagawa ..... 227/155
5,474,222 A * 12/1995 Kanai et al. ..... 227/131
5,660,314 A * 8/1997 Magnusson et al. ..... 227/155
5,720,423 A * 2/1998 Kondo et al. ..... 227/132
5,791,548 A * 8/1998 Udagawa et al. ..... 227/131
5,927,585 A * 7/1999 Moorman et al. ..... 227/132
5,941,441 A * 8/1999 Ilagan ..... 227/132
6,135,337 A * 10/2000 Harris et al. ..... 227/5

* cited by examiner

*Primary Examiner*—Scott A. Smith
(74) *Attorney, Agent, or Firm*—Michael Best & Friedrich LLP

(57) ABSTRACT

A stapler is provided with a frame and a head assembly pivotally disposed in the frame between a first open position and a second clamped position. The head assembly contains all of the operative elements of the stapler necessary to carry out a stapling operation and is biased toward the open position by a biasing member disposed between the head assembly and the frame. These operative elements include a staple driving mechanism, a motor fixed to the head assembly, a cam member connected to the motor and rotated thereby. The cam member contains at least three surfaces that simultaneously form and drive staples, pivot the head assembly in the frame, and actuate a microswitch controlling power to the motor. The cam member cooperates with a first bar disposed between the frame and a spring assembly to permit the first bar to flex to accommodate varying thicknesses or amounts of paper to be stapled. Fewer operative parts are need because the motor and cam member surfaces all rotate around parallel axes that are perpendicular to the axes about which the head assembly pivots.

21 Claims, 18 Drawing Sheets

STAPLER

TECHNICAL FIELD

The present invention relates to electric motor powered, cam driven fastening tools. More particularly, the present invention relates to cam driven electric staplers.

BACKGROUND

Conventional electric staplers contain various features in an attempt to provide the user with an easier-to-use, quieter, more reliable stapler. These staplers, however, still do not adequately solve the noise, cost, and operational reliability limitations inherent in using numerous reducing and driving gears and multiple separate cam mechanisms to convert motor rotation into operational functions and in using bulky coil spring assemblies to prevent motor binding due to the insertion of relatively thick stacks of paper.

For example, U.S. Pat. No. 5,460,313 discloses a stapler with a motor mounted in the base and having a worm gear to drive a plurality of transversely mounted gears. A pair of arms to drive the staples are mounted transverse to the plurality of gears and are reciprocated by annular cam curves on the gears, cam wheels, and a specially shaped hole on a locking plate. The locking plate is also provided with an arcuate slot to compensate for varying thicknesses of paper to be stapled. The stapler disclosed is a relatively complicated structure using transversely mounted gears, cams, and arms that would likely contribute to operational noise and are subject to less reliable operation.

U.S. Pat. No. 2,770,805 discloses a stapling machine having two pairs of cams, drive cams and control cams. The drive cams rotate in contact with cam rollers disposed on a shaft to drive two separate sets of beams. The cam rollers lift a set of beams and the anvil and pivots the second pair of beams to depress the staple driver. A coil spring assembly attached to the pivoting beams driving the staples the accommodate varying thicknesses of paper and a spring urges the staple driver and the anvil apart. The control cams directly activate contact arms to control the input of power to the motor. This arrangement contains numerous moving parts that pivot along different axes and as such is more costly and less reliable.

Thus, there remains a need for improvements in these types of devices, and the present invention provides these.

SUMMARY OF THE INVENTION

In accordance with the present invention, applicants have developed a more reliable and simpler electric stapler that is less costly and easier to manufacture. The stapler includes a housing or frame and a head assembly pivotally disposed in the frame between a first open position and a second clamped position. The head assembly contains all of the operative elements of the stapler necessary to staple a stack of papers and is biased-toward the open position by a biasing member disposed between the head assembly and the frame.

The operative elements include a staple driving and forming mechanism reciprocally disposed in the head assembly between an up starting position and a down driving position, a motor fixed to the head assembly, and a single, multi-functional cam member connected to the motor and rotated thereby. Upon rotation, the cam member simultaneously forms and drives staples, pivots the head assembly in the frame, and actuates a microswitch controlling power to the motor. In addition, the cam member can drive a flat clinch mechanism.

In order to provide these four functions, the cam member includes a first cam surface to actuate a microswitch, a second cam surface connected to the staple driving mechanism to reciprocate the mechanism, a third cam surface to engage a first bar fixed to the frame to pivot the head assembly, and a fourth cam surface to engage a second bar also fixed to the frame to drive the flat clinch mechanism. The first bar is disposed between the frame and a spring assembly to permit the first bar to flex away from the frame to accommodate varying thicknesses or amounts of paper to be stapled. Fewer operative parts are need, because the motor and cam member surfaces all rotate around parallel axes that are perpendicular to the axes about which the head assembly pivots.

DETAILED DESCRIPTION OF THE PREFERRED EMBODIMENTS

Figure 1:
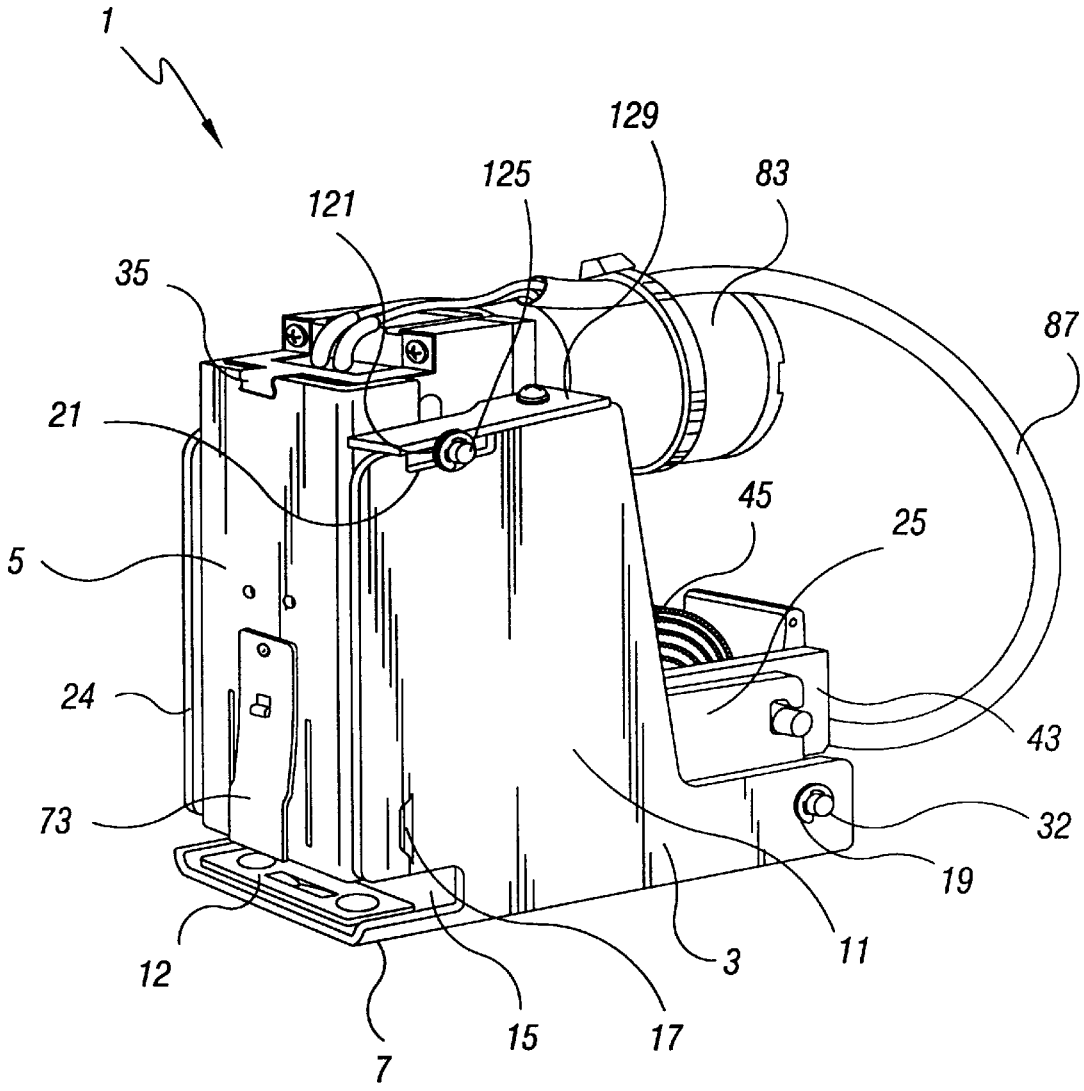
FIG. 1 is a perspective view of a first embodiment of the electric stapler of the present invention.
Figure 2:
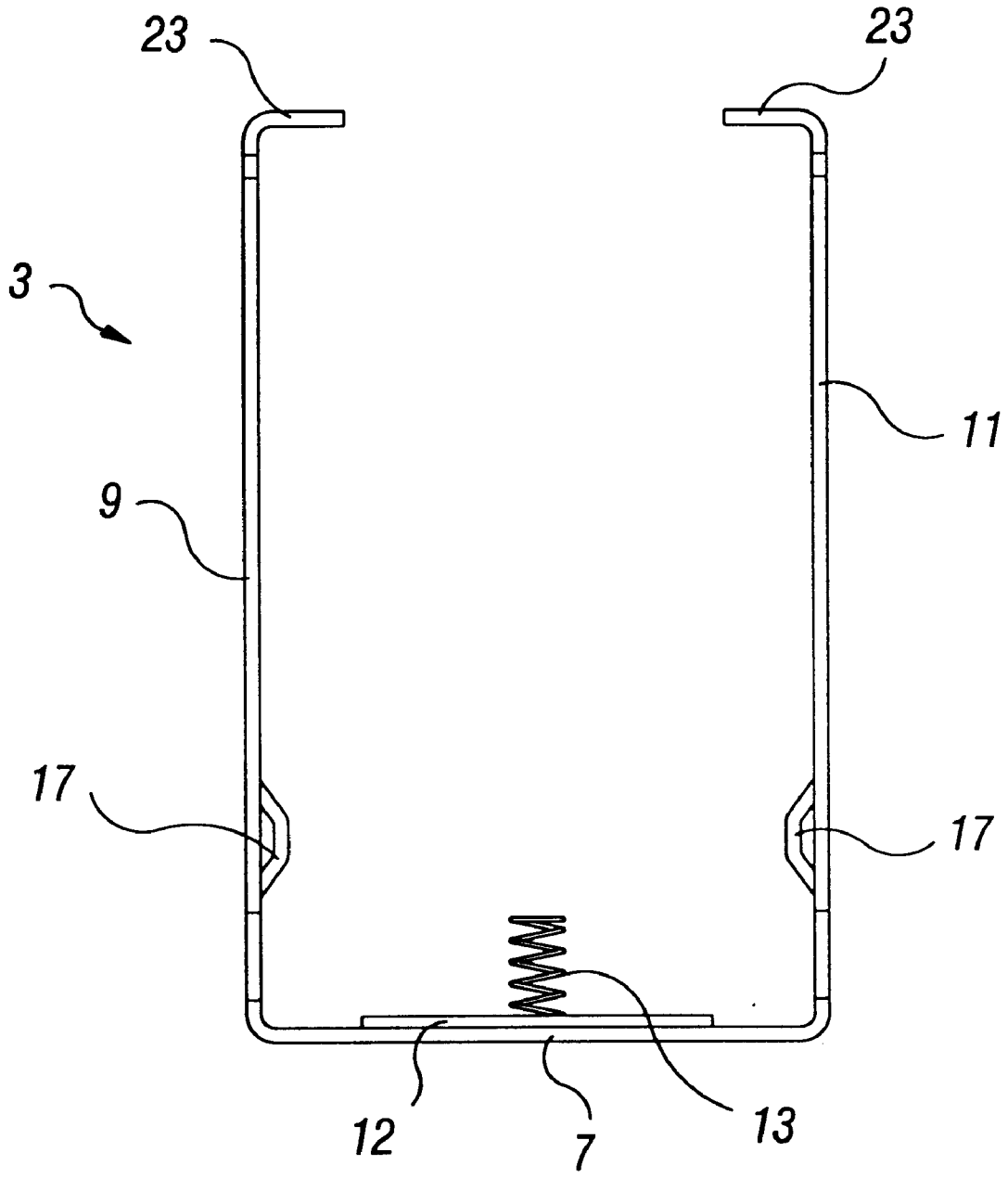
FIG. 2 is a front view of the frame of the stapler.
Figure 3:
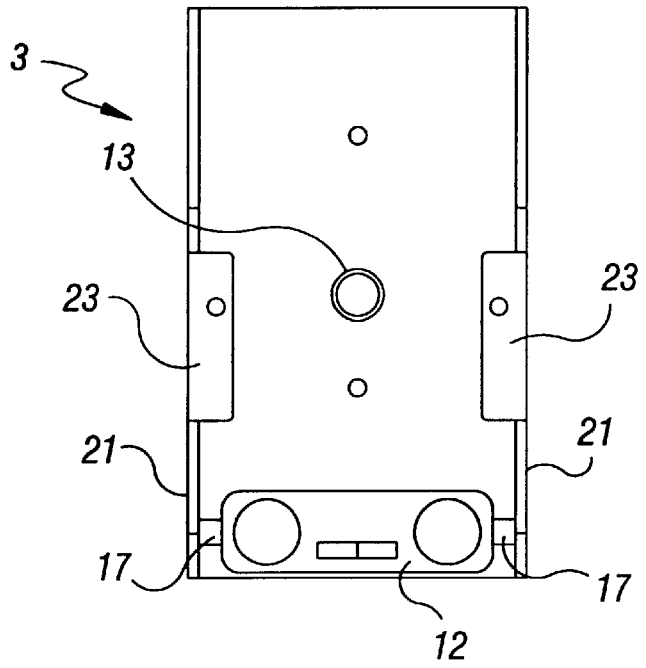
FIG. 3 is a top view of the frame.

Referring initially to FIG. 1, the stapler 1 includes a frame 3 and a head assembly 5 pivotally attached to the frame 3.

Figure 24:
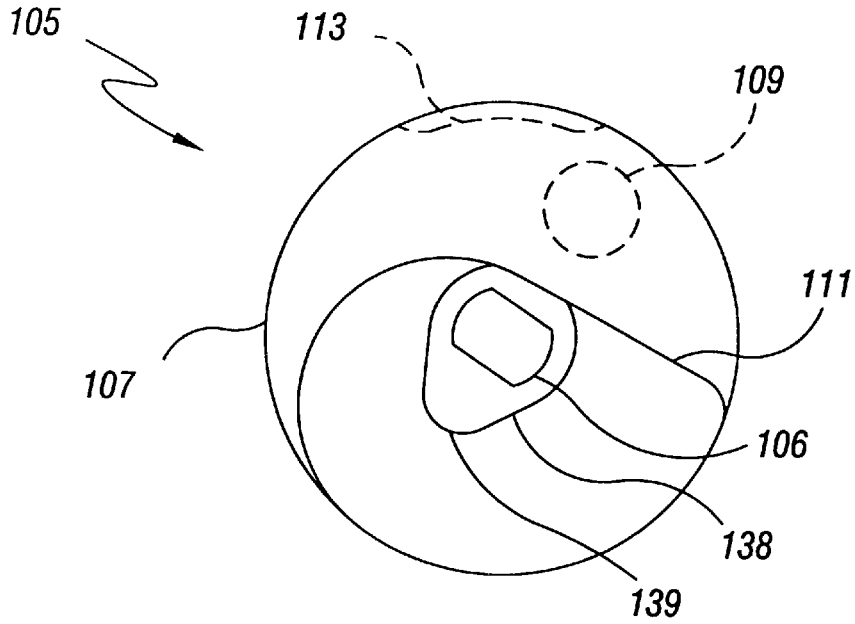
FIG. 24 is a back view thereof.

As is best shown in FIGS. 24, the frame includes a base 7, a first vertical member 9, and a second vertical member 11. An anvil 12 for forming staples is attached to the base 7 as is a biasing member 13. The biasing member 13 is preferably a coil spring, although other types of biasing members such as leaf springs may be used. The first and second vertical members are preferably mirror images of each other. Each vertical member includes a cut-out 15 near the bottom of the vertical member adjacent the end of the base 7 containing the anvil 12 for accepting a stack of papers to be stapled, a detent 17 adjacent the cut-out 15 disposed toward the opposite vertical member to guide the head assembly 5 as it pivots in the frame 3, a hole 19 near the bottom of the vertical member adjacent the end of the base 7 opposite the anvil 12, a notch 21 disposed at the top of the vertical member, and an inwardly curved portion 23 adjacent the notch 21.

Preferably, the head assembly 5 contains all of the operative parts of the stapler 1 necessary to drive staples into a stack of papers. Mounting all of the operative parts of the stapler on the head assembly permits the use of a direct-drive type mechanism with fewer links and gears. This type of direct-drive stapler is more reliable and more cost efficient to produce. The reduction in the number of gears needed by a direct-drive stapler also reduces the noise level associated with the stapler. Further, the same head assembly can be used in any one of a number of frames for modularity of design and production.

Figure 5:
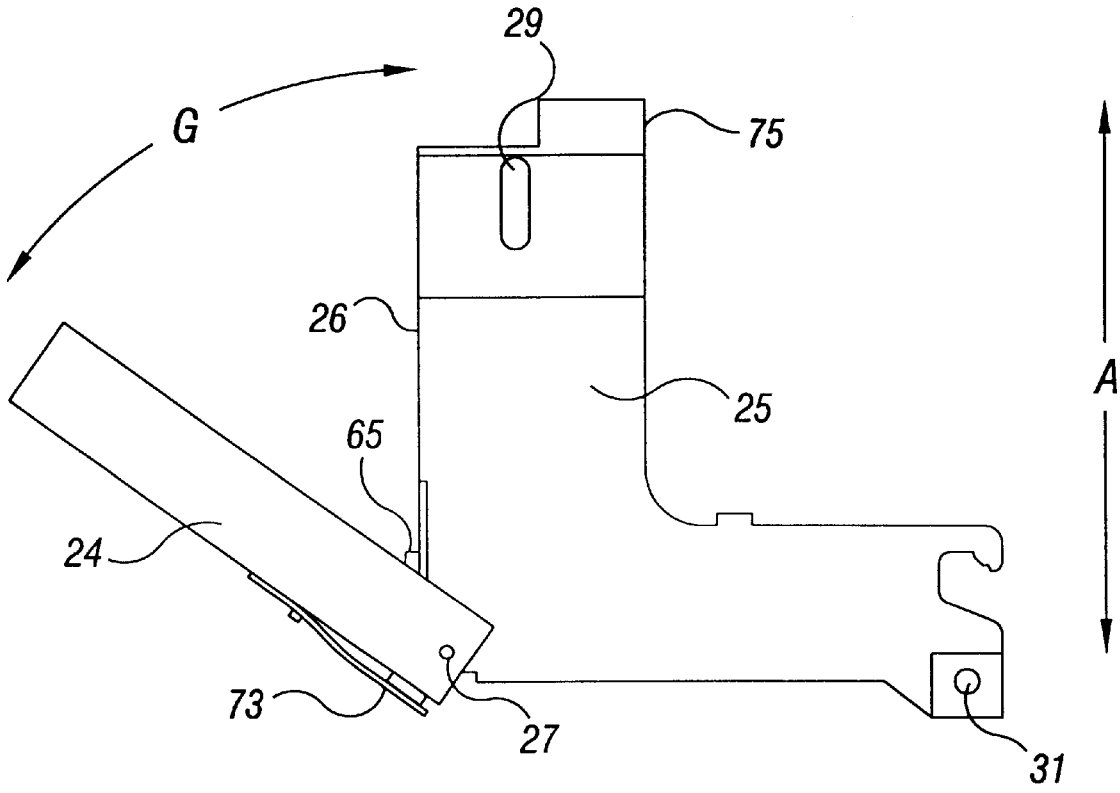
FIG. 5 is a side view of the main body member and front cover of the stapler with the front cover pivoted open.

Referring to FIG. 5, the head assembly 5 includes a front cover 24 hingedly attached to a main body member 25 at the main body member front 26 by a hinge pin 27. The main body member 25 is preferably made of plastic and includes a first cavity 29 passing completely through the main body member 25 and a pivot hole 31 for use in pivotally attaching the head assembly 5 to the frame 3. As is best shown in FIG. 1, a pivot pin 32 is provided passing through the holes 19 in both the first and second vertical members and the pivot hole 31.

The frame and head assembly can pivot about the pivot pin 32 with respect to each other 3 between a first open position and a second clamped position where the head assembly comes into contact with anvil 12. In the embodiment shown in FIGS. 1–6, a stack of papers to be stapled can be inserted into the cut-out 15 when the frame and head assembly 5 are in the first open position and are held securely in the stapler in the second clamped position. In this embodiment, the pivot holes 31 are preferably offset downward form the main body member 25 to accommodate a stack of papers in the first position. In the second embodiment shown in FIG. 7, referred to as a flat-clinch type arrangement, the frame 3 and head assembly 5 also pivot with respect to one another between the first an second positions; however, in this embodiment, the frame 3 pivots with respect to a stationary head assembly 5 as opposed to the head assembly 5 pivoting and the frame 3 remaining stationary as in the first embodiment. In either embodiment, the biasing member 13 urges the frame and head assembly 5 toward the first open position, providing the benefit of a simple return mechanism that allows the frame 3 and head assembly 5 to return to the first open position.

Figure 6:
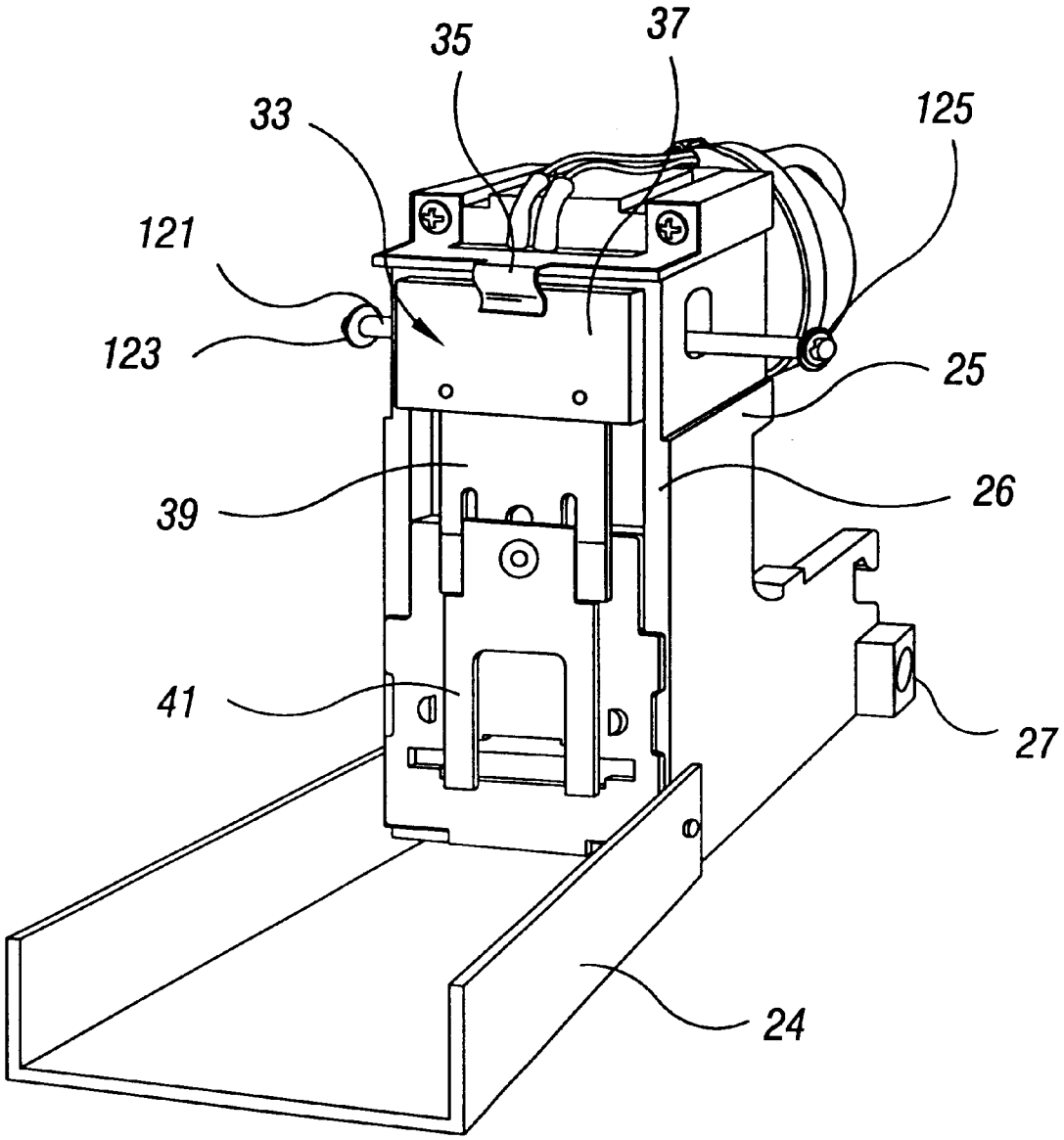
FIG. 6 is a front perspective view of the head assembly of the stapler with the front cover pivoted open.

As can best be seen in FIG. 6, a staple driving mechanism 33 is slideably, reciprocally disposed on the main body member front 26 and is secured to the front 26 by the front cover 24. The front cover 24 is held in a closed position against the main body member front 26 by a clasp 35 attached to the main body member 25. The staple driving mechanism includes a cam follower 37, a staple driving member 39 fixedly secured to the cam follower 37, and a staple forming member 41 slideably attached to the staple driving member 39. Suitable materials for the cam follower 37 include plastics, while the forming member 41 and driving member 39 are preferably made of metal. This arrangement is best suited for staples provided flat and in a roll that need to be formed or bent into a staple shape and then driven through a stack of papers.

Figure 8:
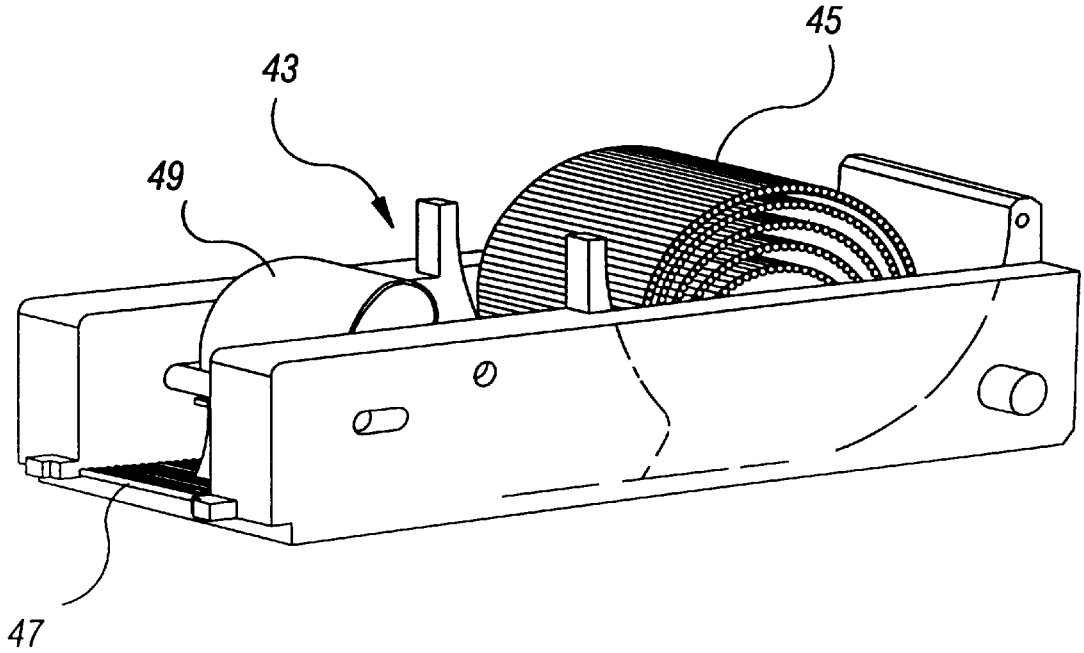
FIG. 8 is a perspective view of the staple cartridge for use in the first embodiment of the stapler.

FIG. 8 shows a staple cartridge 43 that is releasably engaged in the head assembly 5 for supplying such a roll 45 of flat staples. Staples are advanced one at a time toward the discharge end 47 of the staple cartridge 43 by a spring loaded staple advance mechanism 49 that engages the ridges between adjacent staples in the roll 45. Alternatively, staples could be provide that are already shaped.

Figure 9:
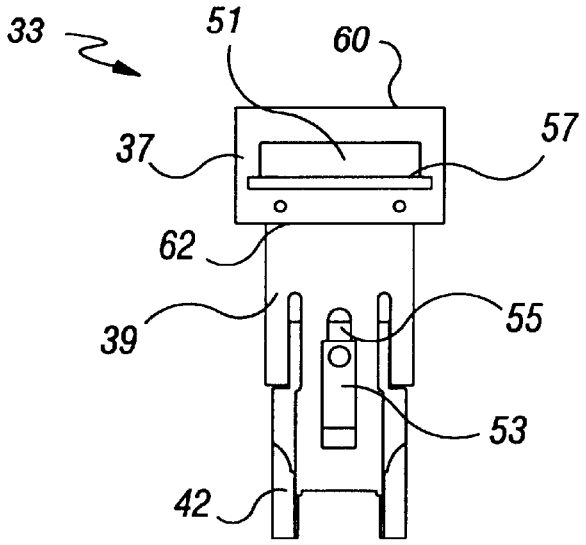
FIG. 9 is the back side view of the staple driving mechanism of the stapler.

As is best shown in FIG. 9, the back side of the staple driving mechanism 33 includes a slot 51 disposed in the cam follower 37 and a staple advance hammer 53 fixedly secured to the staple forming member 41. As the staple forming member 41 slides along the front side of the staple driving member 39, the staple advance hammer, which extends through an elongated hole 55 in the driving member, slides along the back side. The bottom of the slot 51 is provided with a metal bearing surface 57 to improve the wear life of the cam follower 37.

As is best shown in FIGS. 10–13, the main body member front 26 is provided with a cam follower recess 59 for accepting the cam follower 37. The cam follower recess 59 permits the cam follower 37 to rest substantially flush with the main body member front 26 so that the front cover 24 can pivot into a closed position. In addition, the cam follower recess 59 is dimensioned to mate with the cam follower 37 and to provide for sliding reciprocal movement of the cam follower 37 in the direction of arrow A while prohibiting sliding movement of the cam follower in a direction perpendicular to arrow A. The cam follower 37, and hence the staple driving mechanism 33 can slide between an up starting position where the cam follower top side 60 is adjacent the cam follower recess top 61 and a down driving position where the cam follower bottom side 62 is adjacent the cam follower recess bottom 63. The main body member front 26 also includes a metal bearing member 64 and a plurality of semicircular guides 65 to provide for the reciprocal movement of the driver and former portions of the staple driving mechanism 33, a circular cam member recess 67 disposed within the dimensions of the cam follower recess 59, a circular passage 69 passing completely through the main body member 25 and concentric with the cam member recess 67, and a rectangular hole 71 for accepting the staple advance hammer 53 passing completely through the main body member 25. As can best be seen in FIG. 5, the front cover is preferably constructed of metal to support the staple driving member 33 and includes a spring loaded metallic flap 73 to keep pressure against the staple driving portions 39,41.

Figure 13:
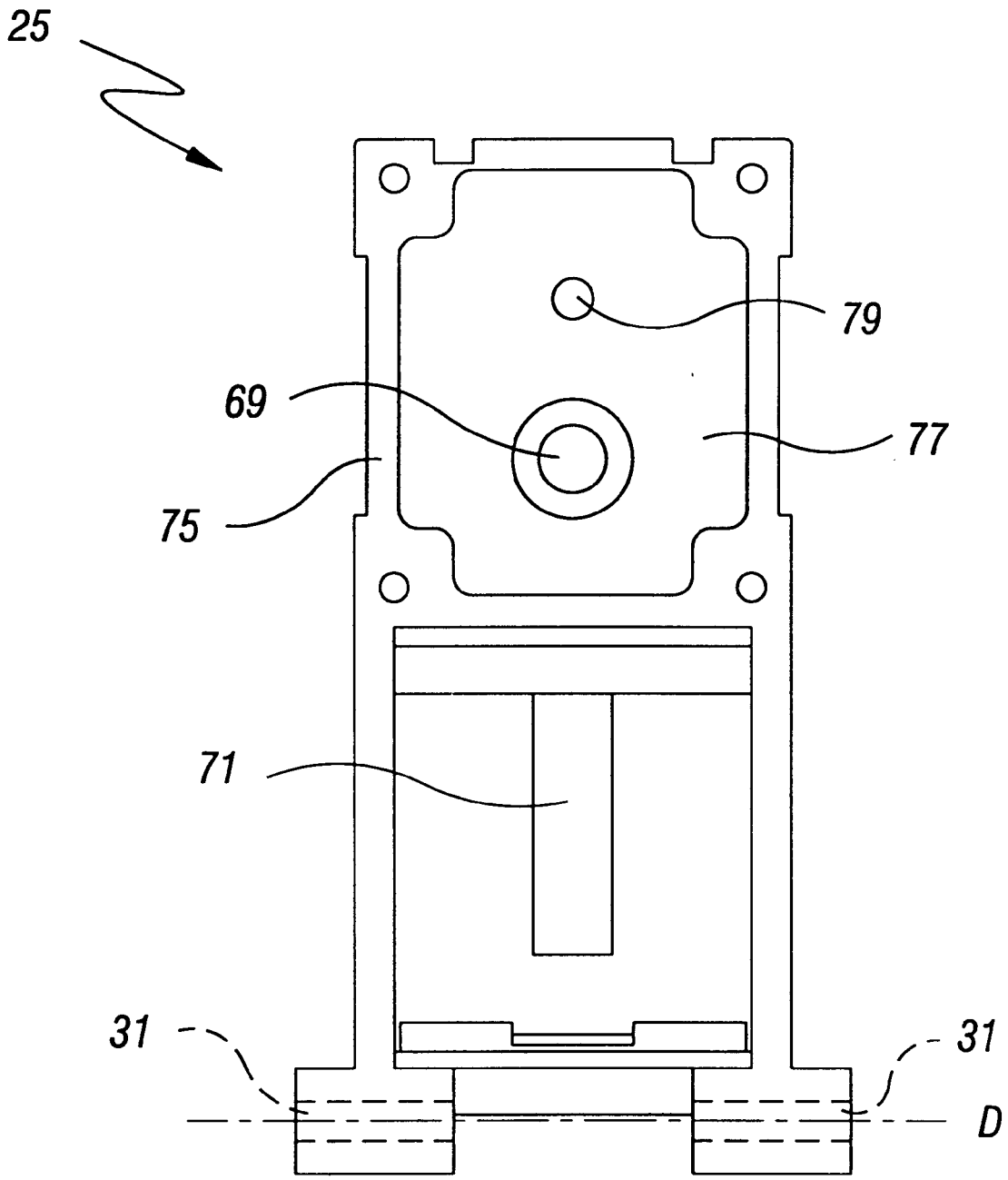
FIG. 13 is a back view of the main body member of the stapler.

As is best shown in FIG. 13, the main body member back 75 includes a drive gear recess 77. Within the gear recess 77 are disposed the circular passage 69 and a cylindrical support post 79. The cylindrical support post 79 is preferably made of metal.

Figure 10:
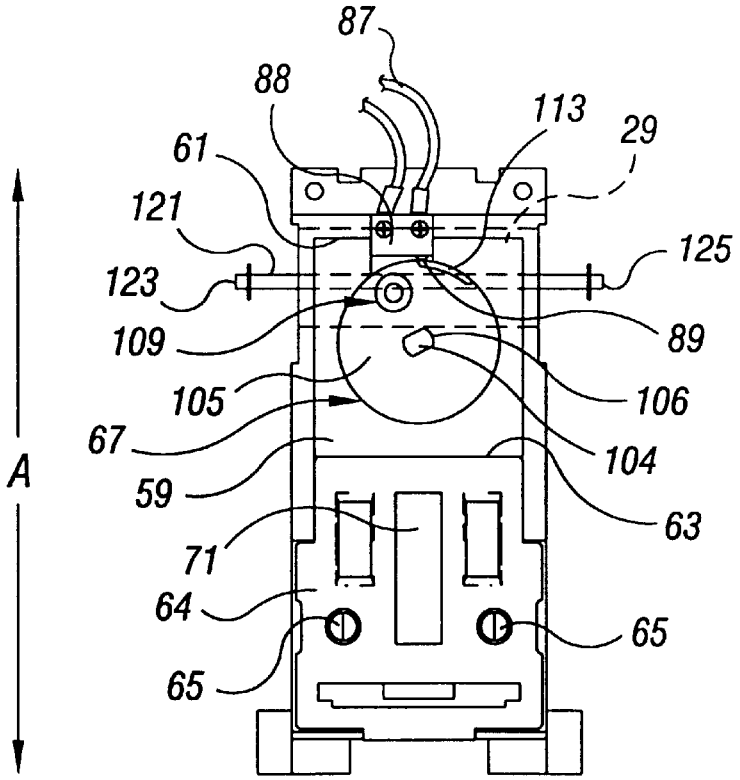
FIG. 10 is front view of the main body member of the stapler with the first bar inserted therein.
Figure 11:
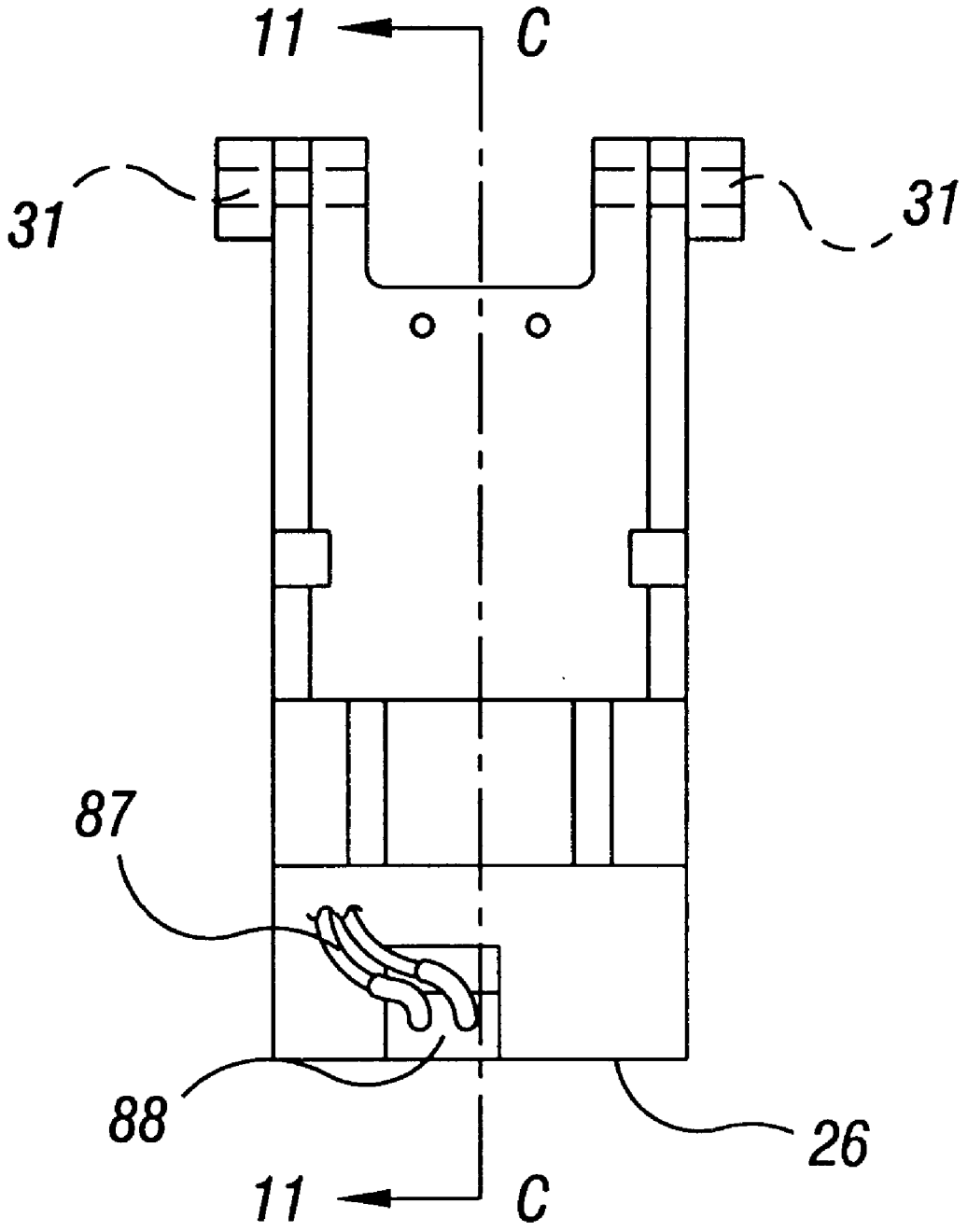
FIG. 11 is a top view of the main body member of the stapler.
Figure 12:
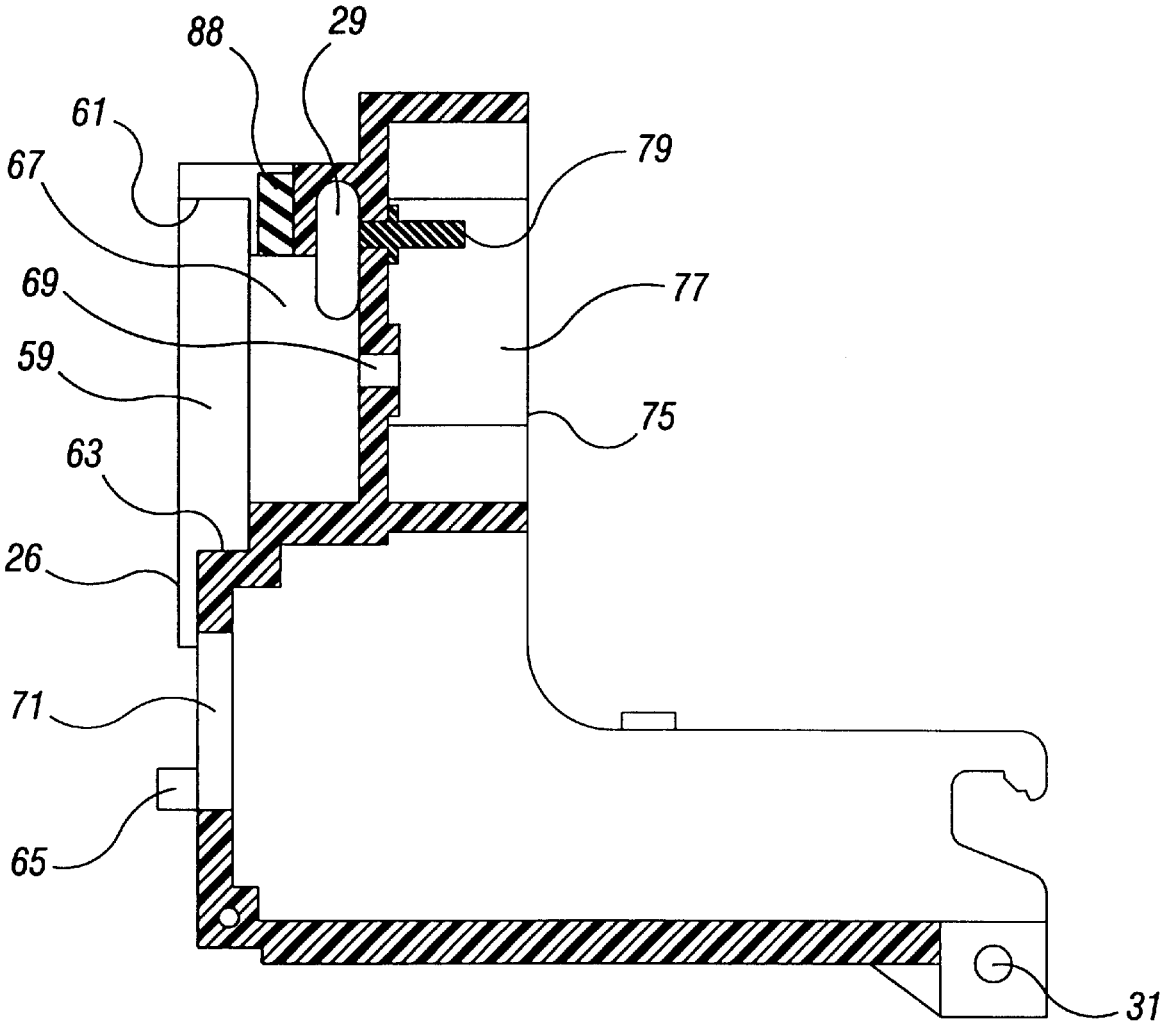
FIG. 12 is a cross-sectional view through lines 11—11 of FIG. 10 showing the main body member internal structure for use in the first embodiment of the stapler.
Figure 14:
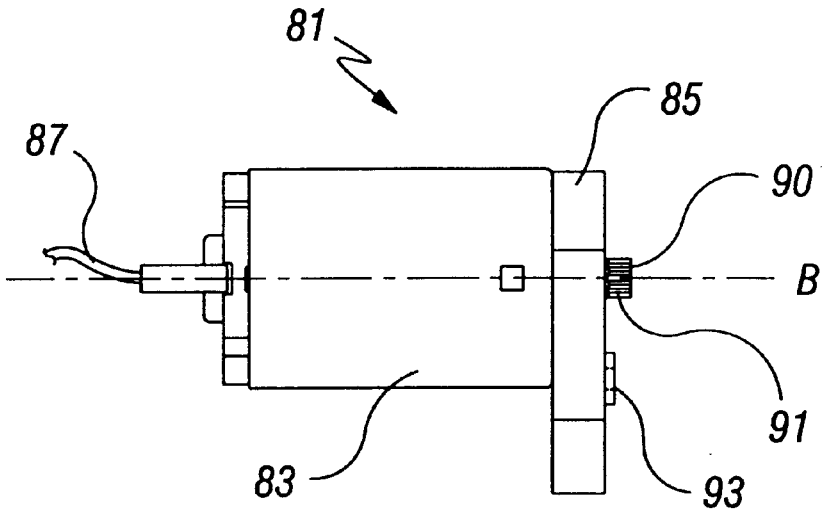
FIG. 14 is a side view of the motor assembly of the stapler.
Figure 15:
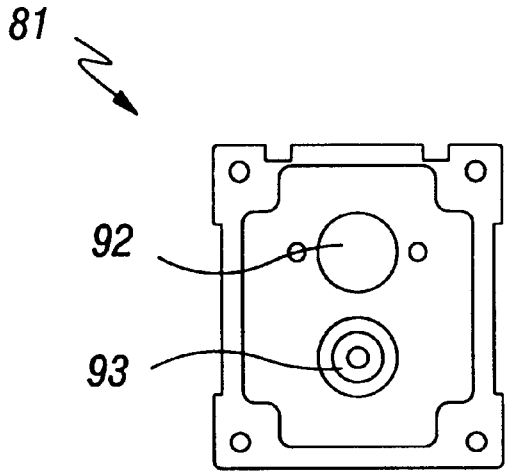
FIG. 15 is a front view of the motor frame of the stapler.

The head assembly 5 further includes a motor assembly 81 as illustrated in FIG. 14. The motor assembly 81 includes a motor 83 mounted by fasteners such as screws to a motor housing 85, although the motor may be directly mounted to the main body member 25. The motor is electrically coupled to a power source by means of electrical leads 87. The electrical leads 87 also connect the motor 83 to a microswitch 88 disposed adjacent the cam member recess 67 as shown in FIG. 10 and capable of selectively supplying power to the motor 83. The microswitch 88 includes a button 89 that extends into the cam member recess 67. The motor 81 includes a pinion shaft 90 disposed along a first axis B, and a pinion gear 91 non-rotatably attached to the pinion shaft 90. As is best shown in FIG. 15, the motor housing 85 includes a passage 92 to accept the pinion shaft 90 and a drive shaft support 93 to support additional gearing as needed. The motor housing 85 is shaped and dimensioned to mate with and completely enclose the gear recess 77 on the main body member back 75.

Figure 16:
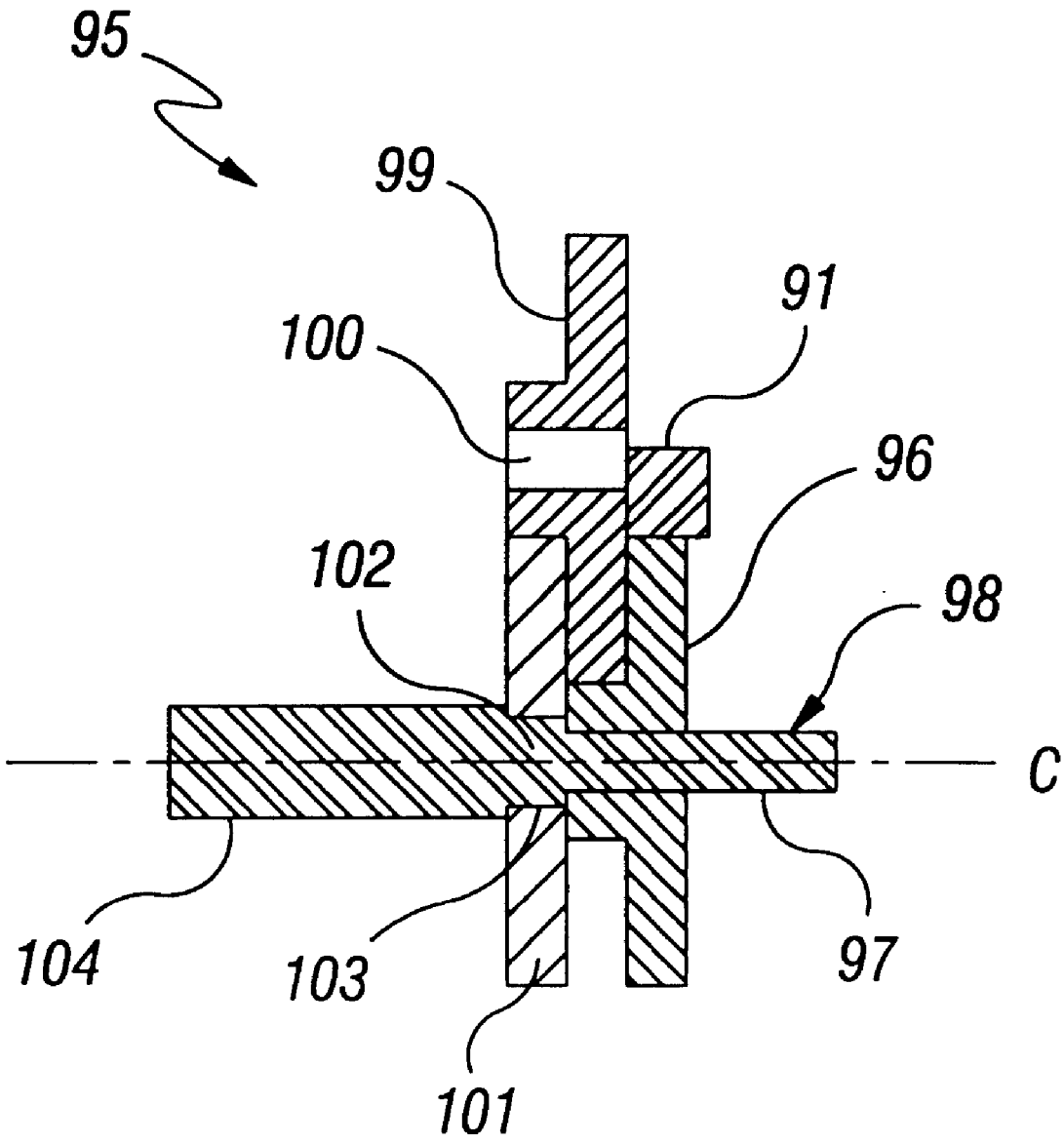
FIG. 16 is a cross-sectional view of the gearing of the stapler.

Although the motor 83 may be directly connected to the operative parts of the stapler 1, it is preferred to provide a plurality of gears 95 as shown in FIG. 16 to connect the motor 83 to the operative parts. The plurality of gears 95 are disposed in the gear recess 77 and include a first gear 96 rotatably mounted nearest the first end 97 of a drive shaft 98 and drivingly connected to the motor pinion gear 91. The first end 97 is support by the motor housing drive shaft support 93, and the first gear 96 is also driving connected to a second non-concentric gear 99 that is rotatably mounted by a central opening 100 on the gear cavity support post 79. The second gear 99 is drivingly attached to a third gear 101 that is non-rotatably mounted on a non-circular mid-portion 102 of the drive shaft 98 by a matingly shaped non-circular central opening 103. The non-circular second end 104 of the drive shaft 98 passes through the circular passage 69 and is disposed in the cam member recess 67. The drive shaft 98 rotates about a second axis C, and the second axis is preferably parallel to the first axis B. As is best shown in FIG. 13, the head assembly 5 pivots about a third axis D passing through the pivot hole 31 in the main body member 25. The axis D is preferably perpendicular to axes B and C.

Figure 17:
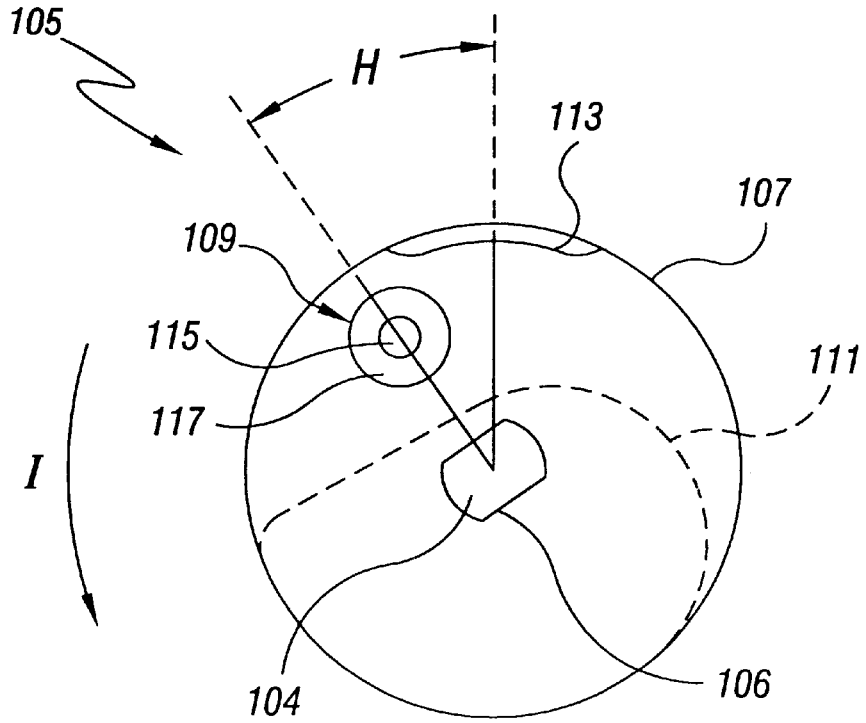
FIG. 17 is a front view of one embodiment of the cam member to be used with the first embodiment of the stapler.
Figure 18:
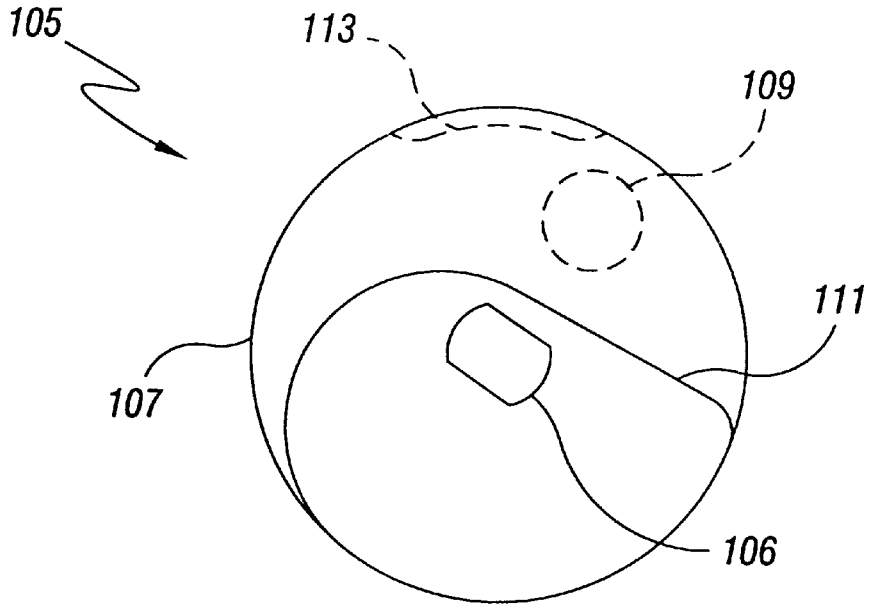
FIG. 18 is a back view thereof.
Figure 19:
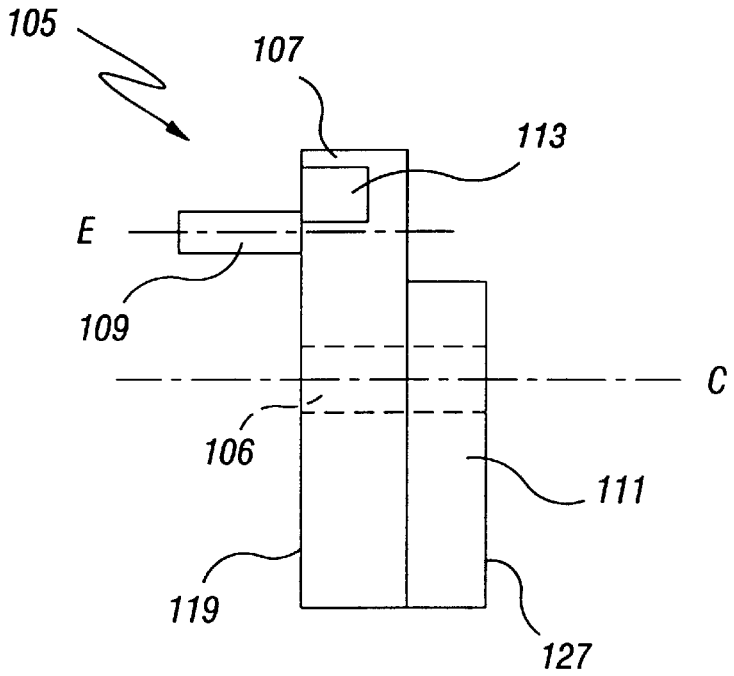
FIG. 19 is side view thereof.

As shown in FIGS. 17–19, a cam member 105 is provided and is disposed in the cam member recess 67. The cam member 105 is capable of providing at least three functions for the operation of the stapler 1. The cam member 105 can actuate the microswitch 88, reciprocate the staple driving mechanism 33 between the up starting position and down driving position, and pivot the frame and head assembly 5 between the first open position and the second clamped position. The cam member 105 is shaped such that it can rotate freely in the cam member recess 67. Preferably, the cam member 105 is circular in shape when viewed from either the front or back and overall is generally cylindrical.

The cam member 105 is connected to and driven by the motor 83. Although the cam member 105 can be directly connected to the motor 83 and driven thereby, the cam member 105 is preferably driven by the motor 83 through the plurality of gears 95 that in turn rotate the drive shaft 98. The cam member 105 has a non-circular central aperture 106 that is shaped to non-rotatably accept the second end 104 of the drive shaft 98.

The cam member 105 includes a plurality of surfaces that perform either separately or in combination the functions of the cam member. Preferably, the cam member 105 includes at least three surfaces, a first cam surface 107 to contact the microswitch 88, a second cam surface 109 connected to the staple driving mechanism 33 to reciprocate the mechanism, and a third cam surface 111 to pivot the head assembly 5. These three surfaces can each represent an individual cam member, with the individual cam members fixedly connected together so as to move in concert to function as a single cam member. Alternatively, the cam member is constructed from a single piece of material with the three surfaces formed integrally therefrom. Preferably, the cam member is constructed such that two of the surfaces are formed from a single piece of material with the remaining surface being a separate cam structure fixedly attached to the single piece of material such that all three surfaces function as a single, unitary cam member. Suitable materials for the cam member 105 include metals and plastics. Preferably, the first and third surfaces are constructed of plastic and the second surface is constructed of metal. This unitary cam member structure reduces the number of components, adding to the simplicity of the stapler and reducing costs.

Figure 20:
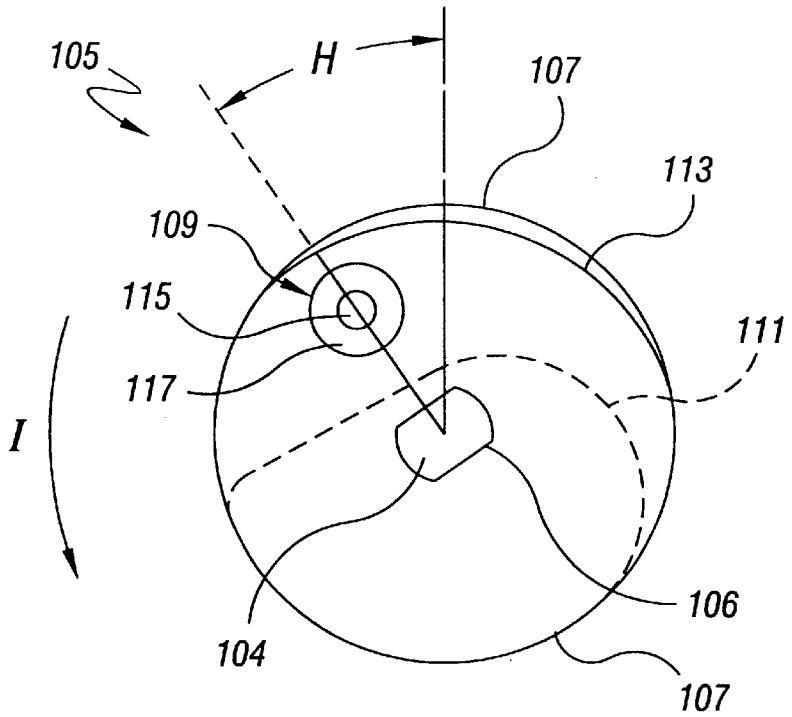
FIG. 20 is a front view of another embodiment of the cam member to be used with the first embodiment of the stapler.

The button 89 of the microswitch 88 extends into the cam member recess 67 in the main body member front 26, and the fist cam surface 107 is arranged to selectively depress or release the button 89. This can be accomplished by varying the distance of the first cam surface 107 form the central aperture 106. As shown in FIGS. 17–19, the first cam surface 107 is preferably the outer circumference of the cam member 105 which is sized to substantially fill the cam member recess 67. Thus, the button 89 is depressed by the cam surface 107. In order to release the button 89 an indentation 113 is provided along the first cam surface 107. Alternate arrangements of the first cam surface are also possible for selectively depressing and releasing the button 89. For example, the radius of the outer circumference could be gradually varied to displace the first cam surface 107 from the button 89 as is best shown in FIG. 20.

The second cam surface 109 is connected to the staple driving mechanism 33 and reciprocates that mechanism between the up and down positions. Preferably, the cam follower 37 includes a slot 51 and the second cam surface 109 is an eccentric post extending from the cam member 105 and engaging the slot 51. The post is constructed of metal and is fixedly attached to the cam member 105. In order to improve operation, the post can be constructed of a central metal post 115 covered by a rotatable metallic collar 117. As is best shown in FIG. 19, the post 109 extends from a first side 119 of the cam member 105 concentric with a fourth axis E, and axis E is parallel to axes B and C and perpendicular to axis D. Having the first, second, and fourth axes parallel to each other eliminates the need for structures such as worm gears or beveled gears to provide a redirection of motion in the operative parts and decreases the overall number or gears needed, reducing costs, increasing simplicity, and eliminating the operational noise associated with those structures.

The third cam surface 111 is preferably a variable radius circular surface concentric with the cam member 105. This radius can vary from the radius of the central aperture up to the outer circumference of the cam member 105 itself. In order to pivot the head assembly 4, the third cam surface 11 engages a first bar 121 fixed to the frame 3. As is best shown in FIGS. 1, 6, and 10, the first bar 121 includes a first end 123 disposed adjacent the first vertical member 9. The first bar 121 passes through the notch 21 in the first vertical member 9 and into the first cavity 29 in the head assembly 5, which is disposed between the first and second vertical members above the base. The first bar 121 emerges from the first cavity 29 on the opposite side of the head assembly 5 and passes through the notch 21 in the second vertical member 11. A second end 125 of the first bar 121 opposite the first end 123 is disposed adjacent the second vertical member 11.

Figure 4:
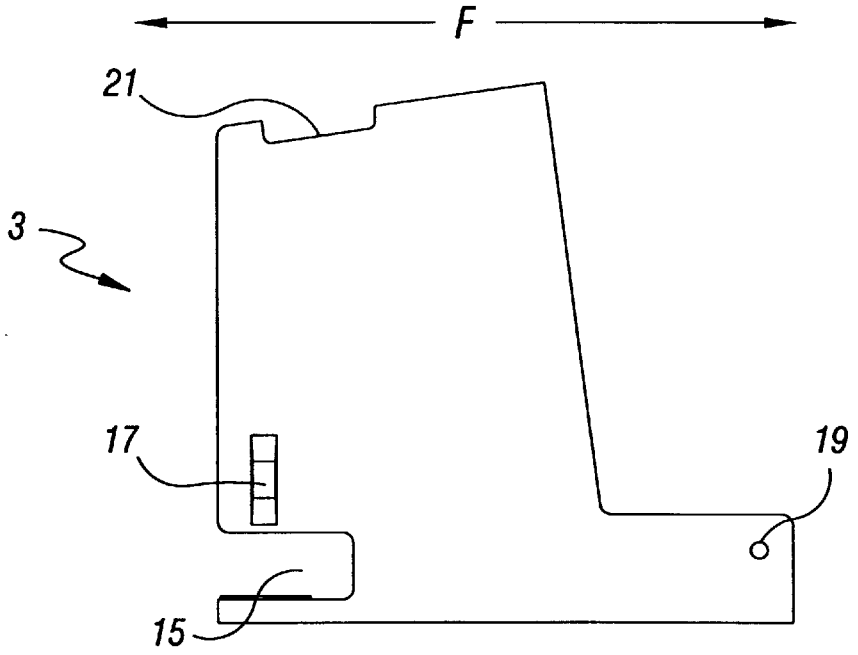
FIG. 4 is a side view of one side of the frame.

The notch 21 is elongated and permits movement of the first bar 121 with respect to the frame 3 generally in the direction of arrow F in FIG. 4, that is back to front. The first cavity 29 is larger than the first bar 121 to permit the first bar 121 to move relative to the head assembly 5 in the direction of arrow A in FIGS. 5 and 10. Preferably, the first cavity 29 has a vertically elongated shaped, and is sized to prohibit front to back movement of the first bar 121 with respect to the head assembly 5. The first cavity 29 intersects the cam member recess 67, permitting the cam member 105 to be adjacent the first cavity 29 so that the first bar 121 can contact with the third cam surface 111. Preferably, the third cam surface 111 is disposed on a second side 127 of the cam member 105 opposite the first side 119.

Figure 7:
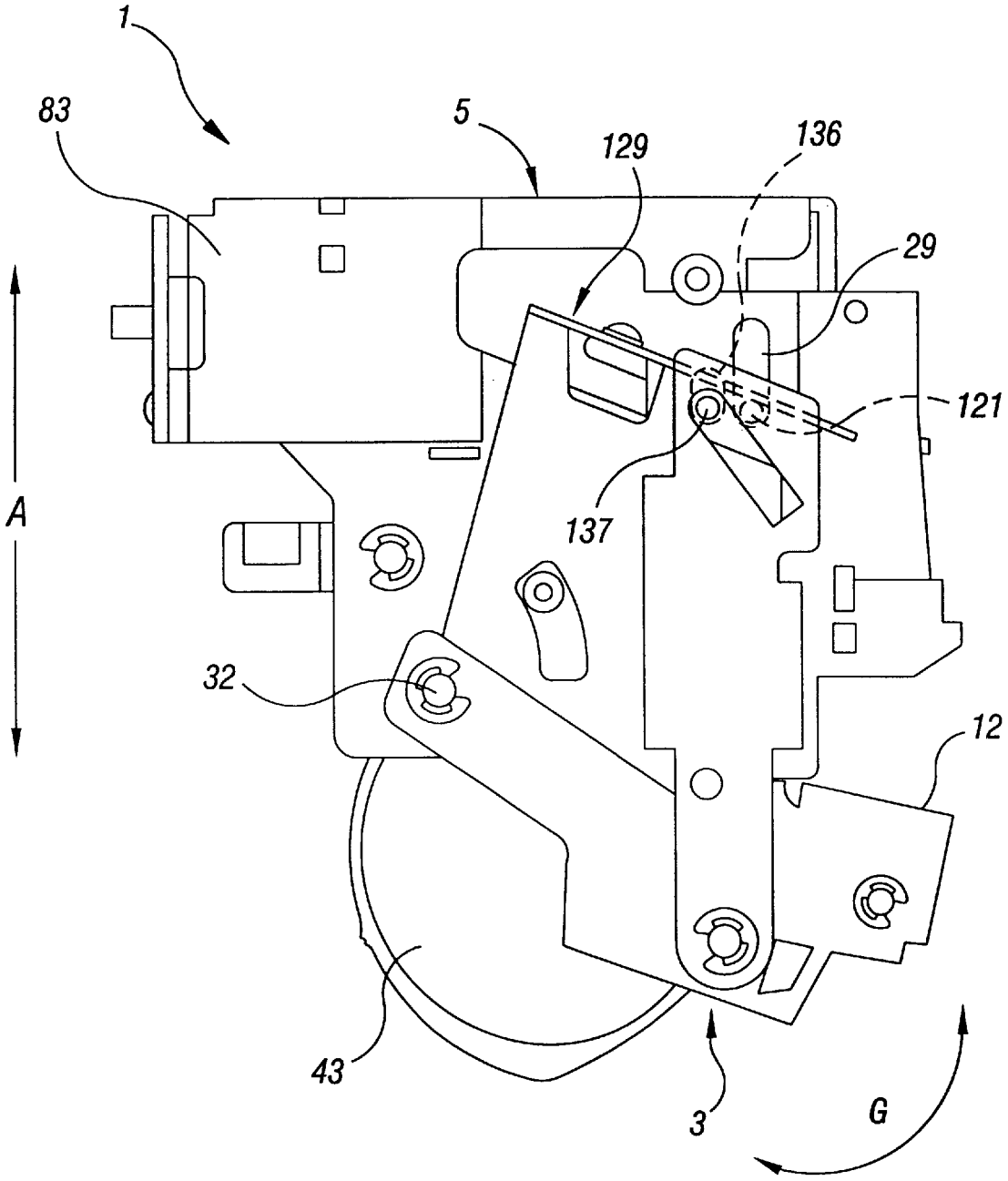
FIG. 7 is a side view of a second, flat-clinch embodiment of the electric stapler of the present invention.

The front to back movement of the first bar 121 with respect to the frame 3 permitted by the notch 21 combined with the top to bottom movement of the first bar 121 with respect to the head assembly 5 make possible the pivotal movement of the head assembly 5 with respect to the frame 3 indicated by arrow G in FIGS. 5 and 7. The distance that the head assembly 5 pivots in the direction of arrow G can be affected by the number of sheets of paper inserted into the cut-out for stapling. However, the distance of vertical travel in the first cavity 29 by the first bar 121 and the displacement of the first bar 121 by the third cam surface 111 are a constant for a given arrangement of the first cavity 29, first bar 121, and third cam surface 111. This constant is set by the distance that the head assembly 5 must rotate to come into contact with the anvil 12. If the constant is set so that the distance of travel is too great, then the third cam surface 111 will bind against the first bar 121, because the first bar 121 cannot continue to move vertically, causing stapler failure or incomplete stapling. Similarly, if a large enough stack of papers is inserted into the stapler for stapling, binding can result. Since it is often desirable to staple a relatively large stack of papers, this tendency to bind must be alleviated.

Figure 21:
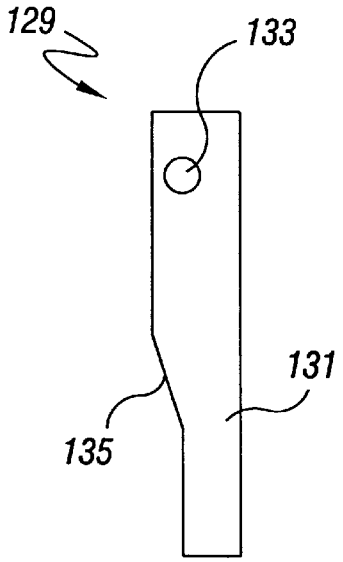
FIG. 21 is a top view of the leaf spring of the stapler.

In order to prevent binding of the stapler during stapling of relatively large amounts of paper, the first bar 121 is attached to the first and second vertical members in a spring loaded manner that permits the first bar 121 to flex vertically upward away from the frame 3, providing an effective additional degree of vertical movement. As is best shown in FIG. 1, each of the first and second ends 123, 125 of the first bar 121 is disposed between the first and second vertical members 9,11 respectively and a spring assembly 129. Preferably, the spring assembly 129 is a leaf spring assembly. Leaf springs are preferred because of a reduction in size and cost over coil springs. As is best shown in FIG. 21, the leaf spring assembly 129 includes a generally rectangular piece of flexible sheet metal 131 that includes a hole 133 and a contour 135. The hole 133 accepts a screw or comparable type of mechanical fastener for attachment of the sheet metal 131 to the inwardly curved portions 23 of the vertical members. A contour 135 compensates for the size and shape of the head assembly 5 and in particular the front cover 24.

Figure 22:
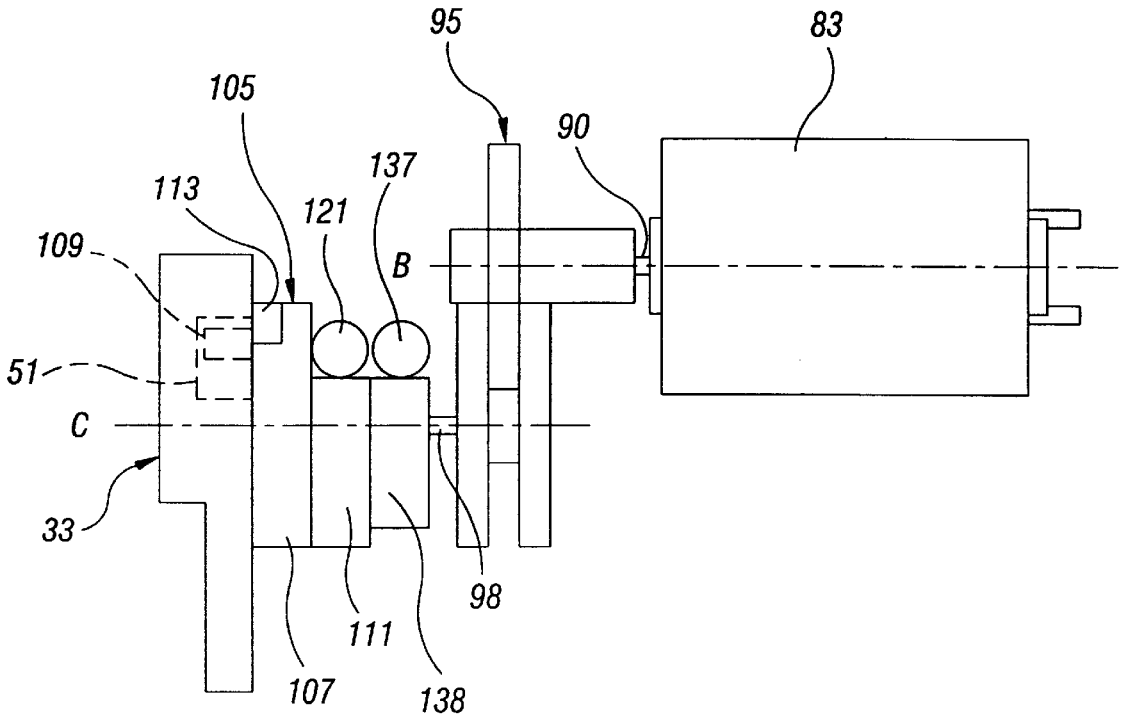
FIG. 22 is s partial side view of the motor and cam member of the second, flat-clinch embodiment of the stapler.
Figure 23:
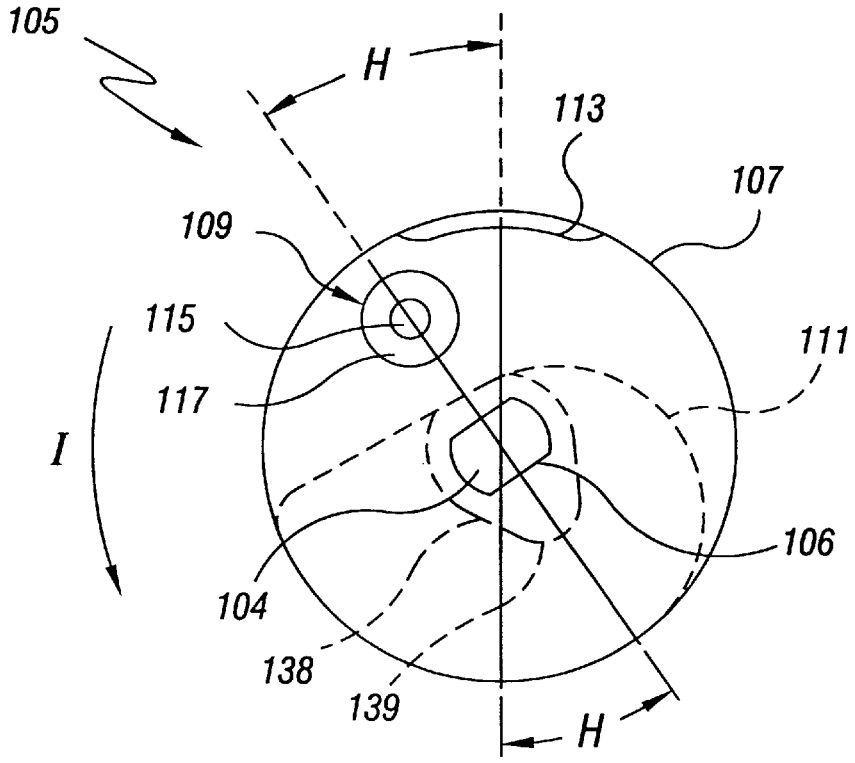
FIG. 23 is a front view of another embodiment of the cam member to be used with the second embodiment of the stapler.
Figure 25:
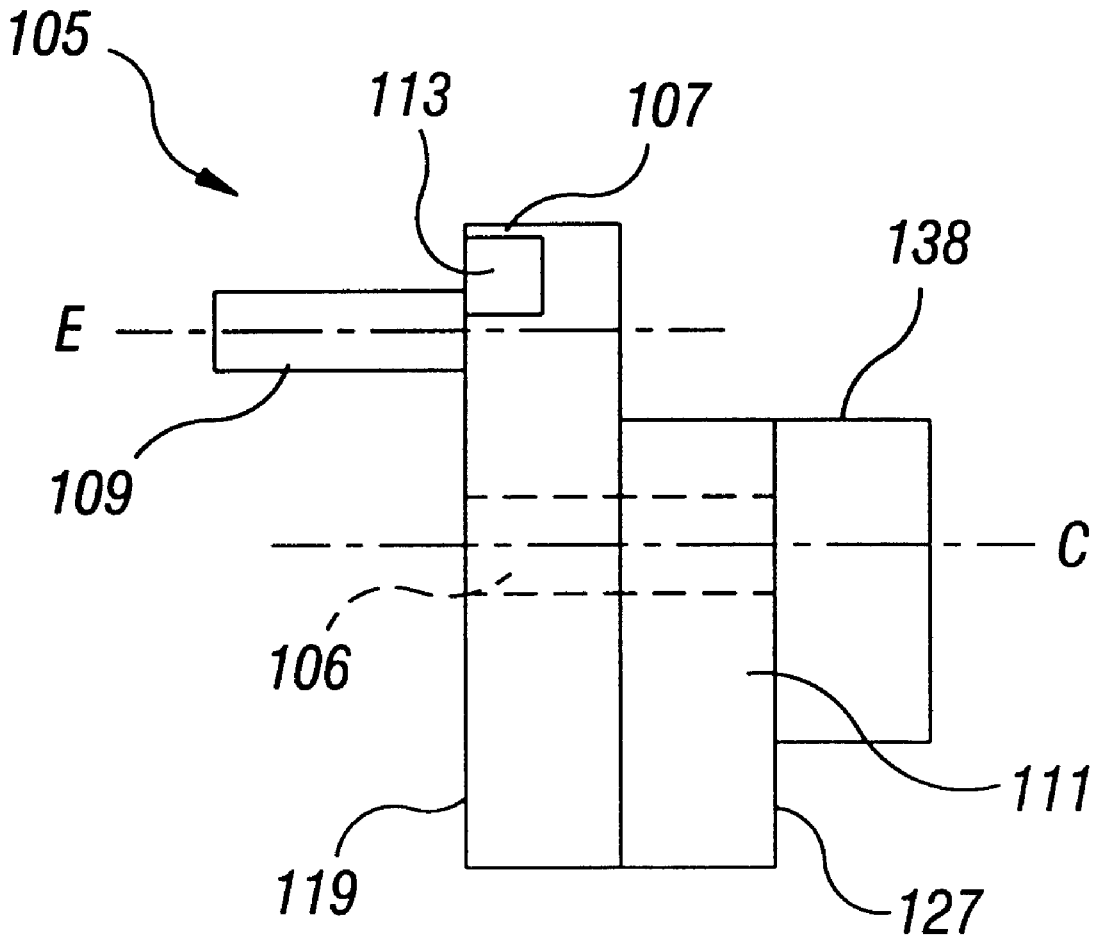
FIG. 25 is side view thereof

Alternatively, as is best shown in FIG. 7, the head assembly 5 can be provided with a second cavity 136 for accepting a second bar 137 that like the first bar 121 is attached to the frame. The second cavity 136 is larger than the second bar 137 to permit the second bar 137 to move relative to the head assembly 5 in the direction of arrow A in FIG. 7. Preferably, the second cavity 136 has a vertically elongated shaped, and is sized to prohibit front to back movement of the second bar 137 with respect to the head assembly 5. The second cavity 136 intersects the cam member recess 67, permitting the cam member 105 to be adjacent the second cavity 136 so that the second bar 137 can contact with a fourth cam surface 138 as is best shown in FIG. 22. Preferably, the fourth cam surface 138 is disposed on the second side 127 of the cam member 105 opposite the first side 119 such that the third cam surface 111 is disposed between the fourth cam surface 138 and the first cam surface 107. As is best shown in FIGS. 23–25, the fourth cam surface 138 is preferably a variable radius circular surface concentric with the cam member 105. This radius can vary from the radius of the central aperture up to the outer circumference of the cam member 105 itself. In order to drive the flat clinch mechanism after the head assembly 4 and frame 3 are pivoted together, the fourth cam surface 138 engages the second bar 137 which is fixed to the frame 3 in a similar fashion to the first bar 121. Preferably, the fourth cam surface 138 includes a maximum radius portion 139 that actually engages the second bar 137 to drive the flat clinch mechanism. As is best shown in FIGS. 23 and 24, this maximum radius portion 139 is relatively narrow, and the radius change on either side of the portion 139 is preferably rapid, this arrangement drives the flat clinch mechanism rapidly and with minimum rotation of the cam member 105.

In order to operate the stapler of the present invention, a stack of paper to be stapled is insertion into the area of the cut-out 15 in the stapler frame 3 with the head assembly 5 in a first open position where the paper contacts a switch (not shown), providing power to the motor 83. The powered motor 83 rotates its pinion shaft 90 and pinion gear 91, which in turn drive the plurality of gears and the drive shaft 98. The drive shaft in turn rotates the cam member 105 about axis C. As the cam member 105 rotates, the plurality of cam surfaces simultaneously perform their respective operative functions.

The desired sequencing of these functions is accomplished by the alignment and spacing of the surfaces around the cam member 105. Initially, the indentation 113 in the first cam surface 107 is aligned at the top of the cam member 105, and the microswitch button 89 is extended into the indentation 113. The second cam surface 109 spaced radially around the cam member 105 from the indentation 113 an angle H equal to 35–40°, preferably 38°, is engaged in the cam follower slot 51 and the and the staple driving mechanism 33 is in the up starting position. The third cam surface 111 is engaged with the first bar 121 at its shortest radius.

The cam member 105 rotates in the direction of arrow I in FIGS. 17 and 20, and the first cam surface 107 depresses the button, deactivating the microswitch 88. The second cam surface 109 comes into contact with the metal bearing surface 57 of the slot 51, advancing the staple driving mechanism 33 toward the down driving position. The staple supplied the cartridge 43 is sequentially formed and driven into the stack of papers to be stapled, and the staple advance hammer 53 engages the spring loaded staple advance mechanism 49 to provide a staple for the next stapling cycle. Simultaneously, the third cam surface 111 pushes against the vertically fixed first bar 121, pivoting the head assembly 5 toward the second clamped position to secure or clamp the inserted paper during the forming and driving of the staple. Depending upon the amount of paper that has been inserted to be stapled, the spring assembly 129 permits the first bar 121 to flex upward away from the frame, allowing of the head assembly 5 to pivot toward the first open position. When a flat-clinch arrangement is used, the maximum radius portion 139 of the fourth cam surface 138 will then push against the second bar 137, driving the flat-clinch mechanism and clinching the staple around the inserted papers. As is best shown in FIG. 23, the maximum radius portion 139 is disposed across a diameter of the cam member on the opposite side of the center of the cam member 105 from the second cam surface 109.

As the cam member continues to rotate, the second cam surface 109 will begin to return the staple driving mechanism to the up starting position. The third cam surface 111 will rotate to engage the first bar 121 again at a minimum radius, permitting the head assembly 5 to return to the first open position under the force of the biasing member 13. This simple spring loaded return mechanism permits the head assembly 5 to return the first position before full rotation of the cam member 105, releasing the papers and shortening the actual time required for stapling. As the cam member 105 continues to rotate, the button 89 will eventually engage the indentation 113, activating the microswitch 88 and stopping power to the motor 82. The stapler 1 has now completely returned to its initial starting position and is ready for the next stapling sequence.

The description of the operation of the stapler 1 and the cam member 105 illustrates how the arrangement and displacement of the plurality of cam surfaces about the cam member 105 provides a sequencing or timing function to the stapler 1. For example, second cam surface 109, the indentation 113 of the first cam surface 107, and the maximum radius portion 139 of the fourth cam surface are disposed around the cam member 105, and and the third cam surface 111 is shaped such that when the second cam surface 109 has driven the staple driving mechanism 33 fully to the down driving position and the third cam surface 11 has engage the first bar 121 to pivot the frame 3 and head assembly 5 together, maximum radius portion 139 of the fourth cam surface 138 engages the second bar 137 to drive the flat clinch mechanism. Moving these surface with respect to each other will change the timing or sequencing of the operative features, for example to delay activation of one or more stapling operations.

What is claimed is:

1. A stapler comprising:

a frame;

a head assembly pivotally attached to the frame, the frame and head assembly pivotable with respect to one another between a first open position and a second clamped position;

a staple driving mechanism reciprocally disposed in the head assembly between an up starting position and a down driving position;

a motor fixed to the head assembly;

a microswitch disposed in the stapler and electrically coupled to the motor; and a cam member connected to the motor and driven thereby, the cam member comprising:

a first cam surface to contact and to actuate the microswitch;

a second cam surface connected to the staple driving mechanism to reciprocate the mechanism between the up and down positions; and a third cam surface to engage a first bar fixed to the frame to pivot the frame and head assembly between the first and second positions.

2. The stapler of claim 1, wherein the cam member is generally cylindrical in shape.

3. The stapler of claim 2, wherein the first cam surface comprises an indentation in an outer circumference of the cam member.

4. The stapler of claim 2, wherein the second surface comprises a post extending from the cam member and eccentric therewith, the staple driving mechanism comprises a slot, and the post engages the slot.

5. The stapler of claim 2, wherein the third cam surface comprises a variable radius circular surface concentric with the cam member.

6. The stapler of claim 2, wherein the second surface comprises a post extending from a first side of the cam member and eccentric therewith, the third cam surface comprises a variable radius circular surface concentric with the cam member and extending from a second side of the cam member, and the first side is located opposite second side.

7. The stapler of claim 2 wherein the motor comprises a drive shaft disposed along a first axis, the cylindrical cam assembly rotates about a second axis, the first and second axes are parallel, the frame and head assembly pivot with respect to each other about a third axis; and the third axis is perpendicular to both the first and second axes.

8. The stapler of claim 7, wherein the post extends from the cam assembly along a fourth axis, and the fourth axis is parallel to the first and second axes.

9. The stapler of claim 1, wherein sheets of paper to be stapled are inserted between the frame and the head assembly when the frame and head assembly are in the first position, the frame and head assembly contact the sheets of paper in the second position to clamp the sheets of paper in the stapler, the third cam surface engages the first bar to pivot the frame and head assembly toward the second position, and the first bar is disposed between the frame and a spring assembly to permit the first bar to flex away from the frame to permit the frame and head assembly to pivot toward the first position to accommodate varying thicknesses or amounts of paper to be stapled.

10. The stapler of claim 9, wherein the spring assembly is a leaf spring assembly.

11. The stapler of claim 1, wherein the frame and head assembly are biased toward the first position by a biasing member disposed between the frame and the head assembly.

12. The stapler of claim 1, further comprising:

a second bar fixed to the frame to engage a fourth cam surface disposed on the cam member, thereby driving a flat-clinch type staple former.

13. The stapler of claim 12, wherein the fourth cam surface comprises a variable radius circular surface concentric with the cam member.

14. A stapler comprising:

a frame;

a head assembly attached to the frame;

a staple driving mechanism reciprocally disposed in the head assembly between a starting position and a driving position;

a motor fixed to the head assembly; and at least one cam member operatively engaged to the motor for rotation, wherein the at least one cam member has a first cam surface acting on the staple driving mechanism to reciprocate the staple driving mechanism between the starting position and the driving position; a second cam surface to contact and to actuate a switch disposed in the stapler and electrically coupled to the motor; and a third cam surface to engage a first bar fixed to the frame to pivot the frame and head assembly between a first open position and a second clamped position.

15. The stapler of claim 14, wherein the motor is operatively engaged to the at least one cam member by a power transferring assembly.

16. The stapler of claim 15, wherein the power transferring assembly comprises a gear assembly.

17. The stapler of claim 14, wherein the at least one cam member is generally cylindrical in shape.

18. The stapler of claim 14, wherein sheets of paper to be stapled are inserted between the frame and the head assembly when the frame and head assembly are in the first position, the frame and head assembly contact the sheets of paper in the second position to clamp the sheets of paper in the stapler, the third cam surface engages the first bar to pivot the frame and head assembly toward the second position, and the first bar is disposed between the frame and a spring assembly to permit the first bar to flex away from the frame to permit the frame and head assembly to pivot toward the first position to accommodate varying thicknesses or amounts of paper to be stapled.

19. The stapler of claim 14, wherein the motor comprises a drive shaft disposed along a first axis and the at least one cam member rotates about a second axis parallel to the first axis.

20. The stapler of claim 19, wherein the frame and head assembly pivot with respect to each other about a third axis; and the third axis is perpendicular to both the first and second axes.

21. The stapler of claim 14, further comprising:

a second bar fixed to the frame to engage a fourth cam surface disposed on the at least one cam member, thereby driving a flat-clinch type staple former.

* * * * *